US006702290B2

(12) United States Patent
Buono-Correa et al.

(10) Patent No.: US 6,702,290 B2
(45) Date of Patent: Mar. 9, 2004

(54) SPANISH MATCH TABLE AND RELATED METHODS OF PLAY

(76) Inventors: Blas Buono-Correa, P.O. Box 486, Salinas, PR (US) 60751; Juan A. Rodriguez Morell, 69 Miramar St., Ponce, PR (US) 00731; Heriberto Ramos, R.R.-03 Buzon 11900, Añasco, PR (US) 00610

( * ) Notice: Subject to any disclaimer, the term of this patent is extended or adjusted under 35 U.S.C. 154(b) by 0 days.

(21) Appl. No.: 09/902,344

(22) Filed: Jul. 10, 2001

(65) Prior Publication Data

US 2002/0017758 A1 Feb. 14, 2002

Related U.S. Application Data

(60) Provisional application No. 60/216,962, filed on Jul. 10, 2000.

(51) Int. Cl.[7] ..... A63F 1/00
(52) U.S. Cl. ..... 273/292; 273/236; 273/274
(58) Field of Search ..... 273/292, 274, 273/236

(56) References Cited

U.S. PATENT DOCUMENTS 3,806,127 A * 4/1974 Pink ..... 273/294
4,050,698 A * 9/1977 Brown ..... 273/157 R
4,170,358 A * 10/1979 Hancock ..... 273/304
4,714,255 A * 12/1987 Henry et al. ..... 273/249
4,760,527 A * 7/1988 Sidley ..... 463/13
4,827,640 A * 5/1989 Jones ..... 40/27.5
4,913,443 A * 4/1990 Currey, Jr. ..... 273/243
4,926,327 A * 5/1990 Sidley ..... 359/501
5,033,752 A * 7/1991 Bunting ..... 273/251
5,083,794 A * 1/1992 Santagata ..... 273/249
5,607,159 A * 3/1997 Bryson ..... 273/146
5,607,162 A * 3/1997 Boylan et al. ..... 273/274
5,660,389 A * 8/1997 Freda, III ..... 273/249
5,676,376 A * 10/1997 Valley ..... 273/148 R
5,692,755 A * 12/1997 Gutierrez ..... 273/292
5,791,652 A * 8/1998 Nielsen ..... 273/304
5,813,673 A * 9/1998 Richardson ..... 273/274
5,857,677 A * 1/1999 Sum Chau ..... 273/274
5,895,321 A * 4/1999 Gassies et al. ..... 273/148 R
5,941,769 A * 8/1999 Order ..... 273/149 R
5,951,011 A * 9/1999 Potter et al. ..... 273/292
RE36,739 E * 6/2000 Gutierrez ..... 273/292
6,149,156 A * 11/2000 Feola ..... 273/269
6,164,652 A * 12/2000 Lauretta et al. ..... 273/273
6,336,857 B1 * 1/2002 McBride ..... 273/274

OTHER PUBLICATIONS

Scarne's Encyclopedia of Games, "Monte"—1973—pp. 310–311.*

* cited by examiner

*Primary Examiner*—Benjamin H. Layno
*Assistant Examiner*—Delores Collins
(74) *Attorney, Agent, or Firm*—Patent Law Offices of Heath W. Hoglund

(57) ABSTRACT

A table configured for play of the game Monte in a casino includes a number of player positions and a dealer position. It further includes a number of card areas and a number of bet areas. Chips are used to place bets. The casino pays bets in an amount less than the original bet for a window winner and in an amount equal to the bet for a match winner. The bets are paid in chips.

22 Claims, 10 Drawing Sheets

SPANISH MATCH TABLE AND RELATED METHODS OF PLAY

This application claims the benefit of Provisional application No. 60/216,962 filed Jul. 10, 2000.

FIELD OF THE INVENTION

The invention relates generally to a card game suitable for play in a casino and more particularly to the card game Spanish Match or Monte, which is played using a deck of Cards.

BACKGROUND OF THE INVENTION

The game of Spanish Match or Monte has been played for many years. A private house provides a deck of Cards, a table and a dealer. In its most basic elements, the game involves a competition between two cards. Players place a bet on which one of the two cards will generate a match first. If the player is correct, the dealer pays the player; if the player is incorrect, the player forfeits the bet. Although the game of Spanish Match or Monte is popular in private homes, especially in Puerto Rico, it is not played in casinos. This may result from a number of factors. For one, a casino must generate enough revenue from a particular game to pay overhead costs and still leave a profit. Also, the game must have well defined rules of play that avoid the possibility of any misunderstanding between the dealer and the players. In any event, the details of the game will now be described further.

The deck of Cards used for play typically includes four suits each of which is numbered one through seven and ten through twelve (1–7 and 10–12). Thus, the entire deck includes forty (40) cards. The respective suits depict clubs, chalices, swords, and gold coins. Thus, the deck includes four cards numbered two, one of which depicts two clubs, another of which depicts two chalices, another of which depicts two sword coins, and the last of which depicts two gold coins. The cards numbered ten through twelve depict a jack, a queen or a king along with one of the suits. Typically, a dealer uses a single deck of cards and shuffles that deck in between games. Alternatively, multiple decks may be used. The decks not in play are shuffled so that a new deck is ready immediately upon completion of a game. To help avoid mixing together cards from different decks, the decks are chosen with different back and background colors.

Any number of players may participate in the game. To begin, the dealer lays two cards adjacent one another. These two cards are drawn from the bottom of the deck. FIG. 1 shows one example of this. Here the dealer has first placed card 102 and card 104 on table 100. This competition is sometimes termed the upper competition. If the cards match (e.g. two fours of different suits), then the dealer replaces both cards until they do not match. Then, the players may place a bet on which card will generate the first match. To place a bet for card 102, the player places one or more folded bills adjacent card 102. Each player uses a unique set of folds so that the different player's bets may be distinguished. Here, two players have bet on card 102. One of those bets uses bills folded into a square or square folded bills 106, another uses bills folded into a triangle or triangle folded bills 108. Yet another player has bet on card 104 by placing a bill folded into an elongated rectangle or rectangle folded bill 110 adjacent card 104.

On any bet, if the player guesses incorrectly, then the player forfeits the entire bet. If the player guesses correctly and the competition is decided by or before the first card shown after placing the bet and after establishing both competitions, the player is paid seventy-five percent of the bet. For example, if the player bets twenty dollars ($20), then the dealer pays the player fifteen dollars ($15) and returns their bet. If the player guesses correctly and the competition is decided by any card after such first card drawn, the player is paid one hundred percent of the bet. For example, if the player bets ten dollars ($10), then the dealer pays the player ten dollars ($10) and returns their bet.

After giving the players an opportunity to place bets, the dealer calls "no more bets". At this time, the players have finished placing bets on the competition between cards 102 and 104. The dealer then begins another competition by drawing another card, this time from the top of the deck. The dealer places that card, shown as card 112, on the table 100 adjacent to card 102, and diagonal to card 104. If the card has the same value or matches either card 102 or card 104, then it is removed from its original location and placed next to the matching card (shown in FIG. 2 and further discussed below). This action is sometimes referred to as raising the card. Once the dealer raises a card next to card 102 or 104, no new bets may be placed on the competition between those two cards. Absent such a match, the dealer draws another card, again from the top of the deck, and places that card, shown as card 114, on the table 100 adjacent to card 112 and 104, and diagonal to card 102. If card 114 matches card 112, the two cards are removed and replacements are drawn following the same procedure.

Once the second competition between card 112 and card 114 has been established, players may place bets. This competition is sometimes termed the lower competition. Here, one player has bet on card 112 by placing a triangle folded bill 116 adjacent to card 112. This bet was placed by the same player that placed triangle folded bill 108 since these two bets use the same fold pattern. Another player has bet on card 114 by placing a bill with a folded corner or folded corner bill 118 adjacent to card 114.

When cards are removed due to a match in either the first competition or the second competition, the associated number is burned and the remaining cards with that same number will be discarded as they may be drawn for the deck. For example, if the dealer draws a pair of fours when placing the first competition, those fours are removed and a new first competition is established. If another four is drawn while establishing that new first competition, then that four will be discarded without placing it on the table 100. Likewise, if another four is drawn while establishing the second competition, then that four will be discarded without placing it on the table 100.

After giving the players an opportunity to place bets on the second competition, the dealer calls "no more bets." At this time, the players have finished placing bets on the second competition and the dealer begins the match process. Until this time, the dealer has held or placed the deck in a face-down position so that the players can only see cards after they have been drawn from the deck. Now, the dealer turns the deck in a face-up position, shown for example in FIG. 3 as deck 302.

If the top card of deck 302 matches any of the cards in competition, i.e., cards 102, 104, 112 or 114, the dealer declares a winner for the respective competition. The first card is commonly termed "the window," and if a match comes from the window, any players betting on that match will win their bet. That player is termed "a window winner," and will receive payment of seventy-five percent (75%) of their bet plus their original bet.

If the first card does not generate a match, the dealer will continue drawing cards from the top of the deck. Each new card is compared with the cards in competition. If that comparison generates a match, any player betting on the winning card is declared "a match winner," and will receive payment of one hundred percent (100%) of their bet plus their original bet. In other words, the winner is paid a prize in the same amount as their winning bet. When the dealer determines a winner for either of the competitions, the dealer pays or collects all outstanding bets for that competition and clears all of the cards associated with that competition. The dealer will then continue to draw cards from the deck until the remaining competition generates a winner. At that time, the dealer pays or collects all outstanding bets for the remaining competition and may begin a new game.

At any time during the process of drawing cards from the deck to determine a match for the competitions, a player may call to the dealer to suspend play so that the player may enter a new bet. Players who have already placed a bet, and players who have not yet placed any bet may make this call. In response, the dealer suspends play by leaving the last card shown and played on the top of deck 302. This ensures that the next card to be played remains unknown to all players. During this pause, any player may place a new bet on any remaining competition, except competitions having a raised card associated therewith. Such bets are placed slightly outside the area surrounding any previously pending bets, such as bet 304.

After giving players an opportunity to place bets, the dealer declares "no more bets" and the players may no longer place new bets. The dealer then draws the next card to the top of deck 302. If this card determines a competition associated with a new bet in favor of that new bet, then the player is treated as a window winner and will be paid seventy-five percent (75%) of their bet. Any bets placed earlier will be paid as a match winner. Alternatively, if the new card determines a competition associated with a new bet against that new bet, then the player and any other players betting on that side of the competition forfeit their bet. In another alternative, if the new card does not determine a competition associated with a new bet, that bet is moved into the area surrounding any previously pending bets. Subsequently that bet will be treated as any other bets and will be paid as a match winner or forfeited depending upon the result of the associated competition.

At all times during play, new bets may not be placed in a competition with unequal matching conditions. For example, if one side of a competition includes a raised card, then that competition has unequal matching conditions, since the possibility of reaching a match diminishes each time a card is raised.

While establishing the second competition, the dealer may raise more than one card because the associated number was placed in the first competition. If three cards having the same number are raised while establishing the second competition, then the matching card in the first competition necessarily loses.

Turning to FIG. 2, the process of raising cards is further described. While establishing the lower competition between cards 112 and 114, the dealer drew a four card 202. Since that for matched card 104, which was already in play in the upper competition, the dealer raised the four card 202 by placing it on top of card 104. By chance, two additional four cards 204 and 206 were drawn while establishing the lower competition. As a result, the dealer also raised those cards.

Since no four cards remain in the deck, card 104 cannot win the upper competition. Consequently, any bets associated therewith are forfeited. Bets associated with card 102 are paid as a window winner.

The game continues until both competitors generate a match. Bets are paid and collected, and a new game is begun.

SUMMARY OF THE INVENTION

According to one aspect of the invention, a method of operating a table in a casino begins by providing two decks of cards having a different background color. In one embodiment the decks of cards are preferably a Spanish deck. In another preferred embodiment, the decks of cards are a standard casino deck. The casino provides chips of different colors to the players so that one player's chips may be visually distinguished from another player's chips based upon color. The chips include a plurality of denominations that are whole number multiples of ten dollars. The casino establishes an upper competition between two cards from the first deck of cards by placing a first card adjacent a first betting area, and placing a second card adjacent a second betting area. The casino establishes a lower competition between two cards from the first deck of cards by placing a third card adjacent a third betting area, and placing a fourth card adjacent a fourth betting area. The players place bets by positioning the chips in the first, second, third and fourth betting areas. the casino draws cards and places them in a discard area positioned outside the first, second, third and fourth betting area. Each of the cards is compared with the first and second cards in the upper competition and to the third and fourth cards in the lower competition to generate matches there between. The casino moves the bets from a window winner area to a match winner area within the first, second, third and fourth betting areas after drawing one card from the deck and before drawing another card from the deck. The casino tenders payment on any winning bets in an amount that is a whole number multiple of one dollar. This payment is made in an amount less than the bet when such winning bets occur on the first card drawn after placing such winning bets. This payment is made in an amount equal to such winning bets when such winning bets occur after the first card drawn after placing such winning bets. Otherwise, the casino collects any losing bets. During play, the casino automatically shuffles unused cards.

According to another aspect of the invention, a casino operates a table by providing a deck of cards and chips. The chips are given to a plurality of players and include unique indicia so that one player's chips may be visually distinguished from another player's chips. The chips include a plurality of denominations. A dealer establishes a competition between two cards from the deck of cards. The casino bets from players. Each bet is associated with one of the two cards in the competition. The dealer draws cards from the deck of cards to generate a match between one of the two cards in the competition. The casino tenders payment on any winning bets in an amount that is a whole number multiple of one dollar. This payment is made in an amount less than the bet when such winning bets occur on the first card drawn after placing such winning bets. Accordingly, this payment is made in an amount equal to such winning bets when such winning bets occur after the first card drawn after placing such winning bets. Otherwise the casino collects any losing bets.

According to further aspects of the invention, the chips have values that are whole number multiples of ten dollars. The competition between two cards is established by placing a first card adjacent a first betting area, and placing a second card adjacent a second betting area. Bets are accepted in these betting areas. The casino moves the chips associated with a bet from a window winner area to a match winner area after drawing one card from the deck and before drawing a second card from the deck. According to another aspect of the invention, a casino provides a table having a plurality of player positions, an upper and a lower competition area, a first and a second card area within each of the upper and lower competition areas, and a betting area associated with each of the first and second card areas. The betting areas are divided into a window winner area and a match winner area. Each of the first and second card areas define a substantially rectangular boundary having dimensions approximately proportional to those of a deck of cards. The table also has a discard area. The player positions around the table are numbered, and each of the betting areas comprises a plurality of numbered areas each associated with one of the player positions. Each of the plurality of numbered areas includes a portion of the window winner area and of the match winner area.

According to a further aspect of the invention the table has fewer than six player positions.

According to another aspect of the invention, a computer system is configured to operate a casino game. The computer system includes a processor operationally coupled with a display, a deposit recognition system, and a plurality of bet buttons. The computer system is configured to establish a player credit based upon input from the deposit recognition system. The player credit is made in whole number multiples of one dollar. The computer system establishes an upper and a lower competition by displaying two sets of two side-by-side cards. The computer system accepts bets from a player wherein the bets are received through the bet buttons. The computer system displays cards for a match comparison with the upper and the lower competition. The computer system settles bets by increasing the player credit for winning bets. The credit is given in whole number multiples of one dollar. The credit is made in an amount less than the bet for a window winner and in an amount equal to the bet for a match winner.

These and other aspects of the invention will be further appreciated with reference to the drawings and detailed description.

DETAILED DESCRIPTION

Figure 1:
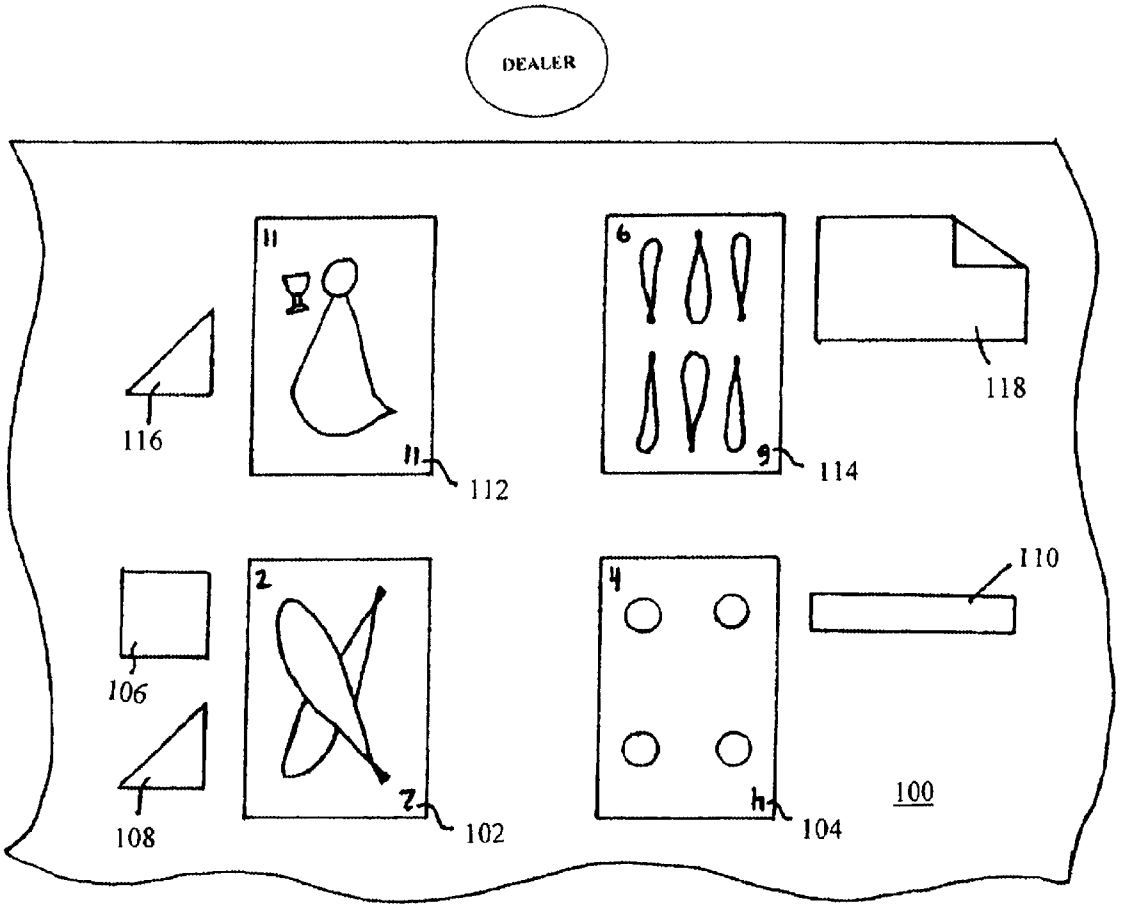
FIG. 1 is a top plan view of a portion of a table showing the game of Monte in play.
Figure 2:
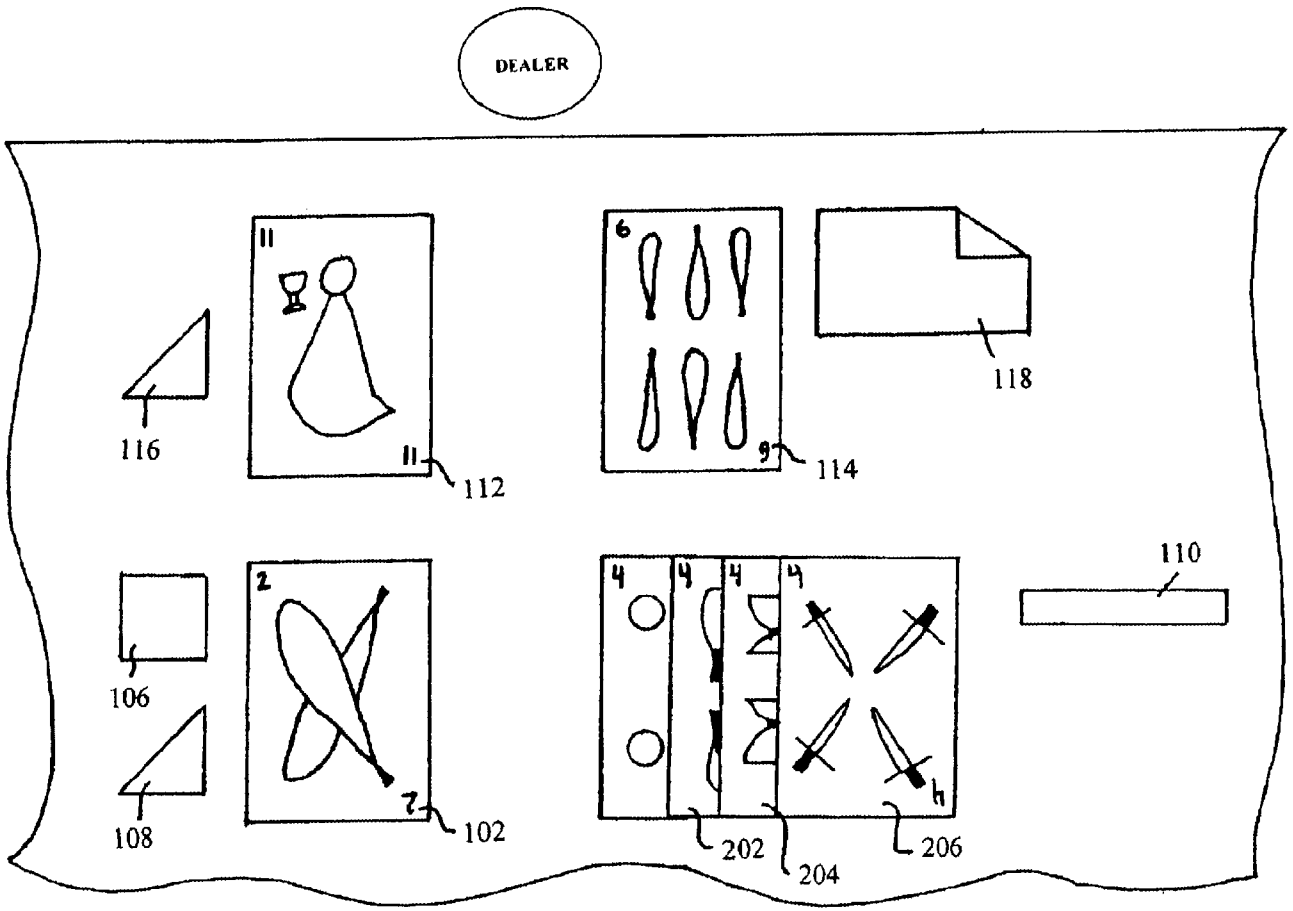
FIG. 2 is a top plan view of a portion of a table showing the game of Monte at another stage of play.
Figure 3:
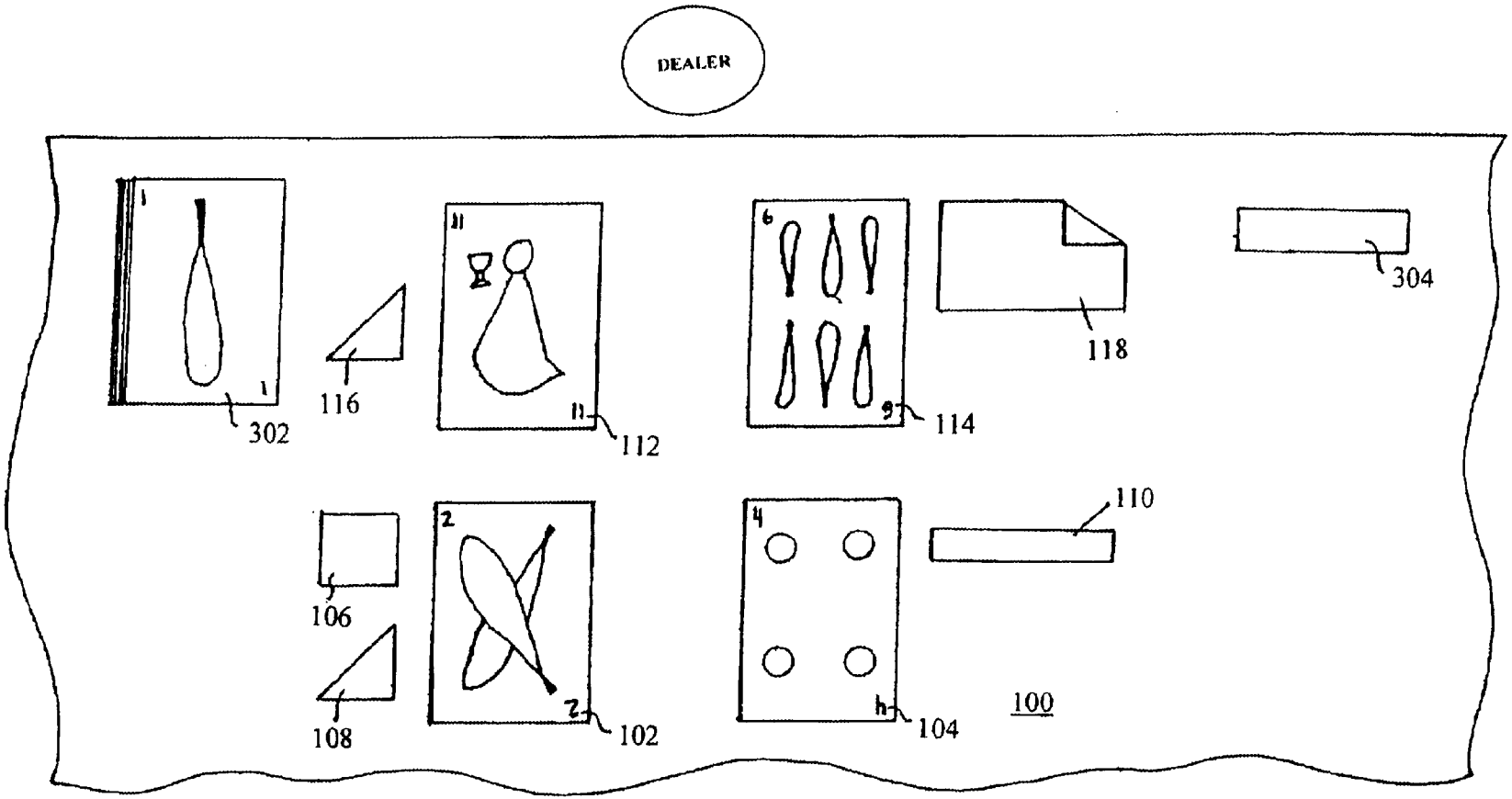
FIG. 3 is a top plan view of a portion of a table showing the game of Monte at another stage of play.

Preferred embodiments of the invention will now be described with reference to FIGS. 4–10, where, generally, common reference numerals have been used to denote the same or similar objects. These preferred embodiments overcome the above-mentioned difficulties and render the game suitable for play in a casino.

In one preferred embodiment, the game is played on a relatively small table managed by a single dealer. The player's bets are placed at specific locations on the table. This configuration allows a casino to minimize overhead because it requires only a single employee to manage the table. The game may be played using a Spanish deck of cards or a standard casino deck of cards.

Figure 4:
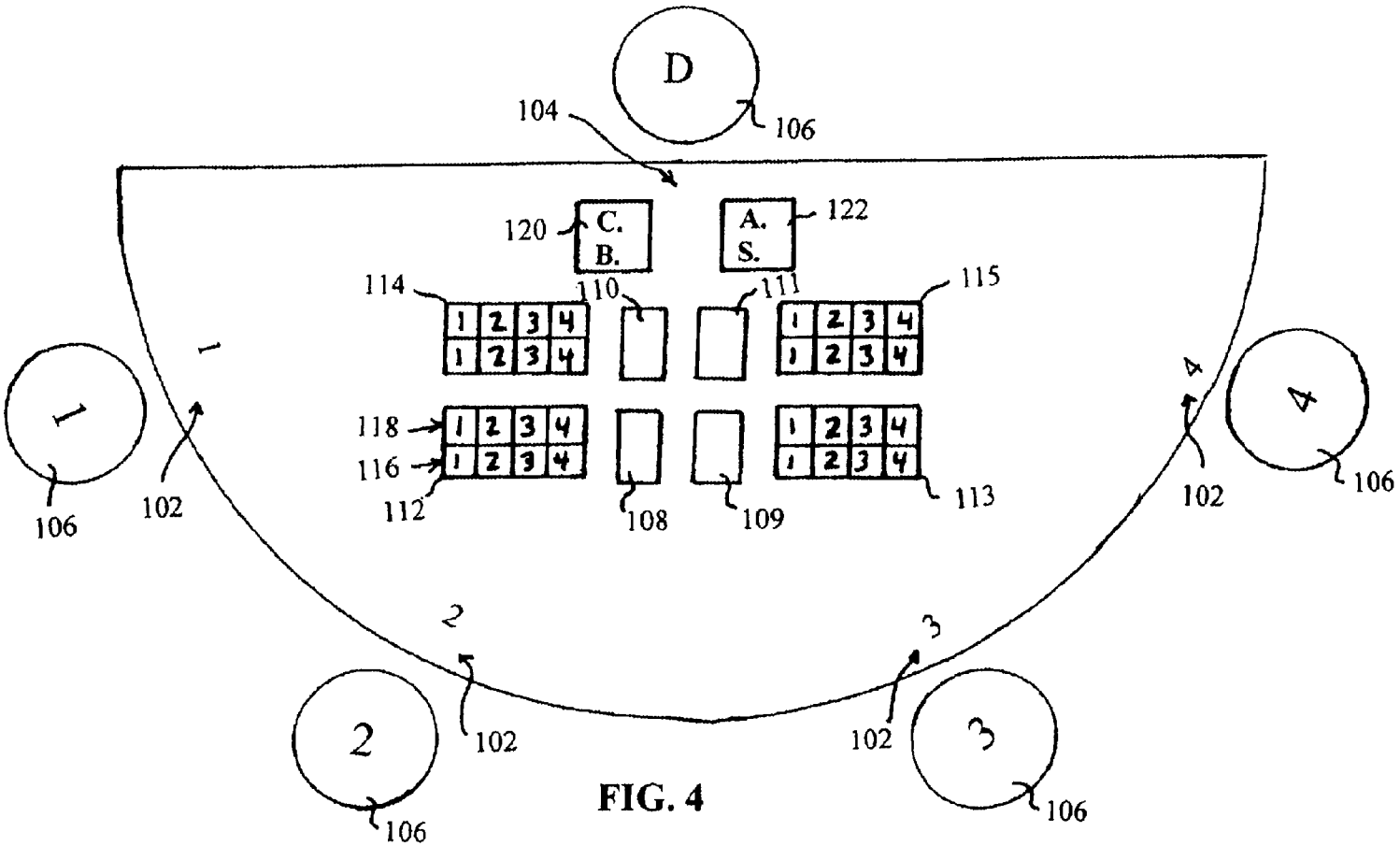
FIG. 4 is a top plan view of one preferred table top configured for play of the game of Monte in a casino.

In FIG. 4, one preferred table suitable for use in a casino is shown. The table includes a top 100 that is preferably covered with a plush, wear-resistant cloth. The top 100 has a semi-circular shape. The perimeter along the curved edge is divided into a plurality of player positions 102, which are numbered one through four (1–4). A dealer position 104 is situated midway along the straight edge of the perimeter. Chairs 106 are provided for each of the players and for the dealer.

From the perspective of the dealer position 104, top 100 includes an upper right rectangle 108 and an upper left rectangle 109, which are used to establish the upper competition. At the start of a new game, a dealer draws two cards and places them in the upper right rectangle 108 and the upper left rectangle 109. As described above, if these two cards match, then they are removed from play and two more cards are drawn. Rectangles 108 and 109 are approximately one inch wider and one inch higher than the width and height of the cards used in play.

Again, from the perspective of the dealer position 104, top 100 also includes a lower right rectangle 110 and a lower left rectangle 111, which are used to establish the lower competition. After establishing the upper competition and accepting any bets on that competition, the dealer draws two more cards and places them in the lower right rectangle 110 and the lower left rectangle 111. As described above, if either of these cards matches one of the cards in the upper competition, or any cards removed from the upper competition, then they are also removed and may be placed next to the matching card in the upper competition. After establishing the lower competition, players may place bets on this competition as well. Rectangles 110 and 111 are the same size as rectangles 108 and 109.

Figure 5:
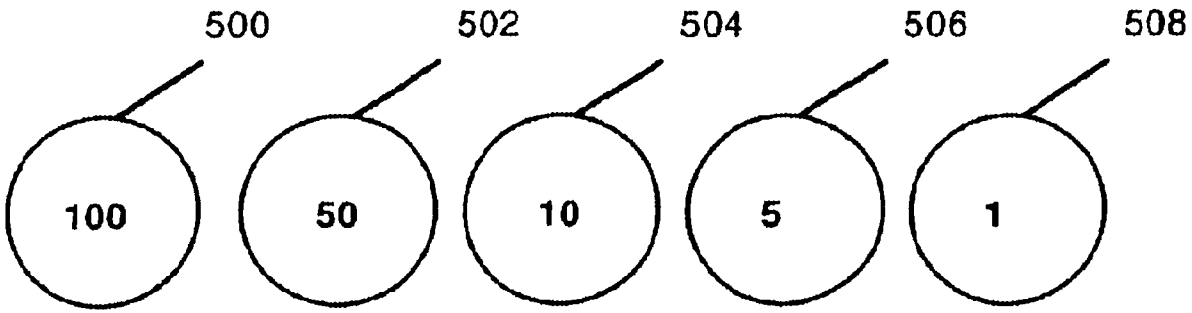
FIG. 5 is a top plan view of one preferred set of chips suitable for use with the table top of FIG. 4.

Before entering the game, a player must purchase chips from a cashier. One preferred chip set is shown in FIG. 5, and will be described further below.

Top 100 also includes bet areas 112–115, which are used to enter bets on the upper and lower competitions. More specifically, players may place bets on the upper competition by placing chips in the upper right bet area 112 (associated with upper right rectangle 108), or on the upper left bet area 113 (associated with the upper left rectangle 109). Likewise, players may place bets on the lower competition by placing chips in the lower right bet area 114 (associated with lower right rectangle 110), or on the lower left bet area 115 (associated with lower left rectangle 111).

Each of the bet areas 112–115 has the same form, and that form will be described with reference to upper right bet area 112. Specifically, it is shaped substantially as a rectangle having a length approximately twice its width. The rectangle is divided once along is its length to provide a window winner row 116 and a match winner row 118. The rectangle is divided three times along its width to provide a column for each of the four players. Thus the rectangle is divided into eight chip areas.

Initially, a player places a bet by positioning one or more chips in the window winner row at the player's respective column. After the competitions are established, the dealer begins to draw cards. The player's chip remains in the window winner row only during the first card drawn after placing the bet. If a match for the associated competition is generated on that draw and the player selected the winning card, then the player is compensated at the window winner rate. If a match is not generated, then the dealer moves the player's chip from the window winner row 116 to the match winner row 118. The chip remains in the same column during this move. The dealer then continues to draw cards. When a match is generated for the associated competition and the player selected the winning card, then the player is compensated at the match winner rate. Otherwise, the player forfeits the bet.

Since players always place bets in the window winner row 116, this row is situated closer to player positions 102 than the match winner row 118. Similarly, the player's columns are arranged in the same order as their respective positions. This helps to minimize the maximum distance between player position and bet area.

Top 100 also includes a recessed area for a chip box 120. To pay bets, the dealer draws chips from chip box 120. The chips are placed next to the winning bet and are then moved proximate the position of the winning player. To collect losing bets, the dealer simply removes chips associated with such bets to the chip box 120.

Finally, top 100 includes a recessed area for an automatic shuffler 122. Preferably, the dealer uses two decks of cards. One may be printed using red ink and the other using blue ink so that the back and background colors of the two decks may be distinguished easily. While one deck is in play, the dealer places the other deck in the automatic card shuffler 122. By the time play has completed, the decks are swapped and a new game may be started immediately.

Turning to FIG. 5, one preferred chip set is described. The chips include a one-hundred dollar chip 500, a fifty dollar chip 502, a ten dollar chip 504, a five dollar chip 506 and a one dollar chip 508. To ensure that the chips are easily distinguished, each denomination is minted in a different color.

By house rules, a player may place a bet only in multiples of ten dollars and a window winner is paid seven dollars for every ten dollars bet. Thus, the five dollar chip 504 and the one dollar chip 508 may not be used to place bets. Instead, these chips are used to pay window winners. For example, if a player becomes a window winner on a ten-dollar bet, then that player will receive their original bet plus the five dollar chip 504 and two of the one dollar chips 508 from the dealer. Similarly, if a player becomes a window winner on a twenty dollar bet, then that player will receive their original bet plus one of the ten dollar chips 504 and four of the one dollar chips 508 from the dealer.

In another preferred mode of play, house rules permit bets placed in multiples of five dollars, and the window winner is paid at a rate of 0.7 dollars for every one-dollar bet. Where this results in payment owed to a player in a fraction of a dollar, a one-dollar chip is presented for placement by the player on a new bet. For example, if a player wins as a window winner on a five dollar bet, then the player is due three and one half dollars from the dealer. The player receives three dollars in chips directly, and another one dollar that must be placed as a bet. (This technique is known and is sometimes used in the casino game of blackjack.)

Figure 6:
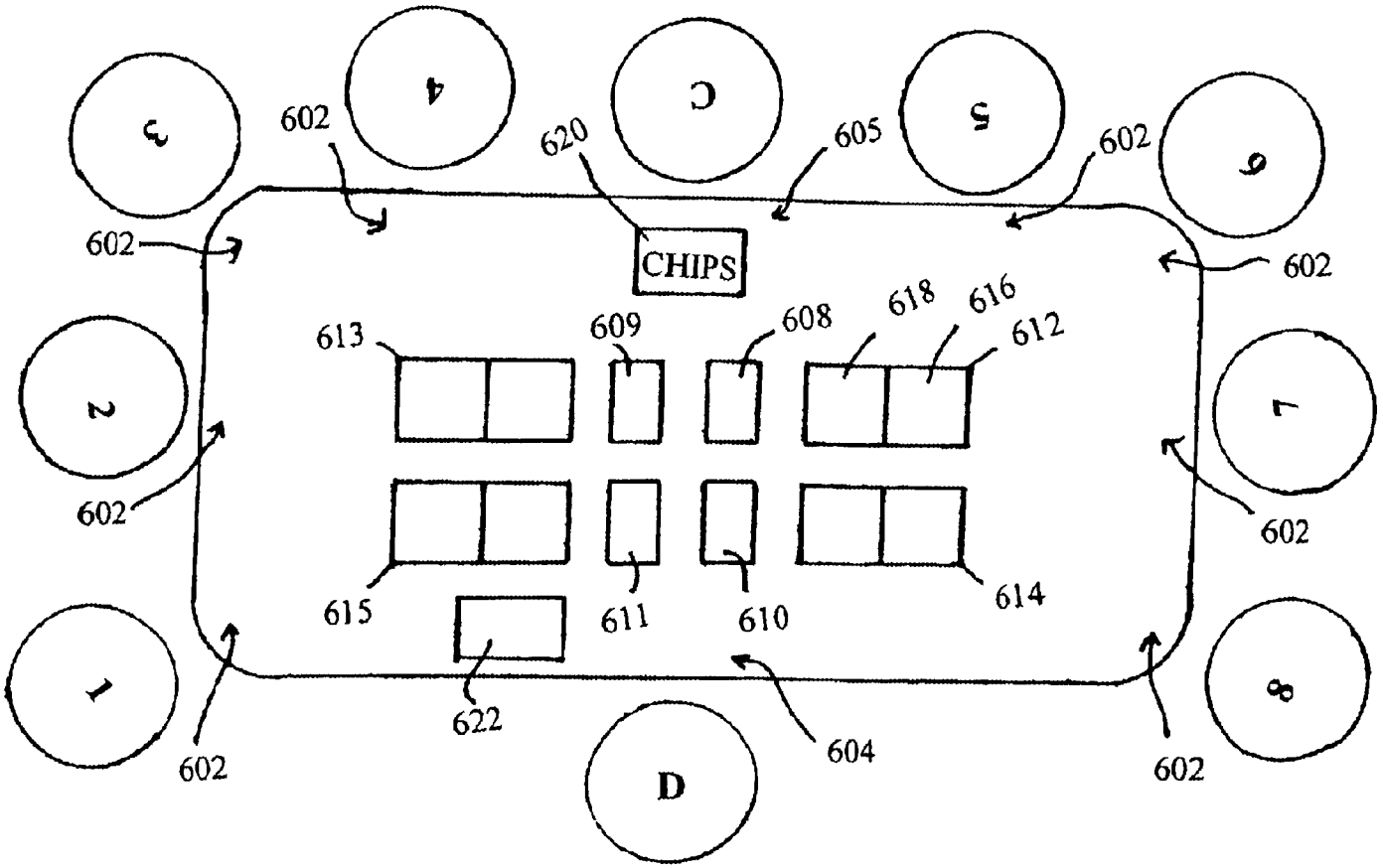
FIG. 6 is a top view of another preferred table top configured for play of the game of Monte in a casino.
Figure 7:
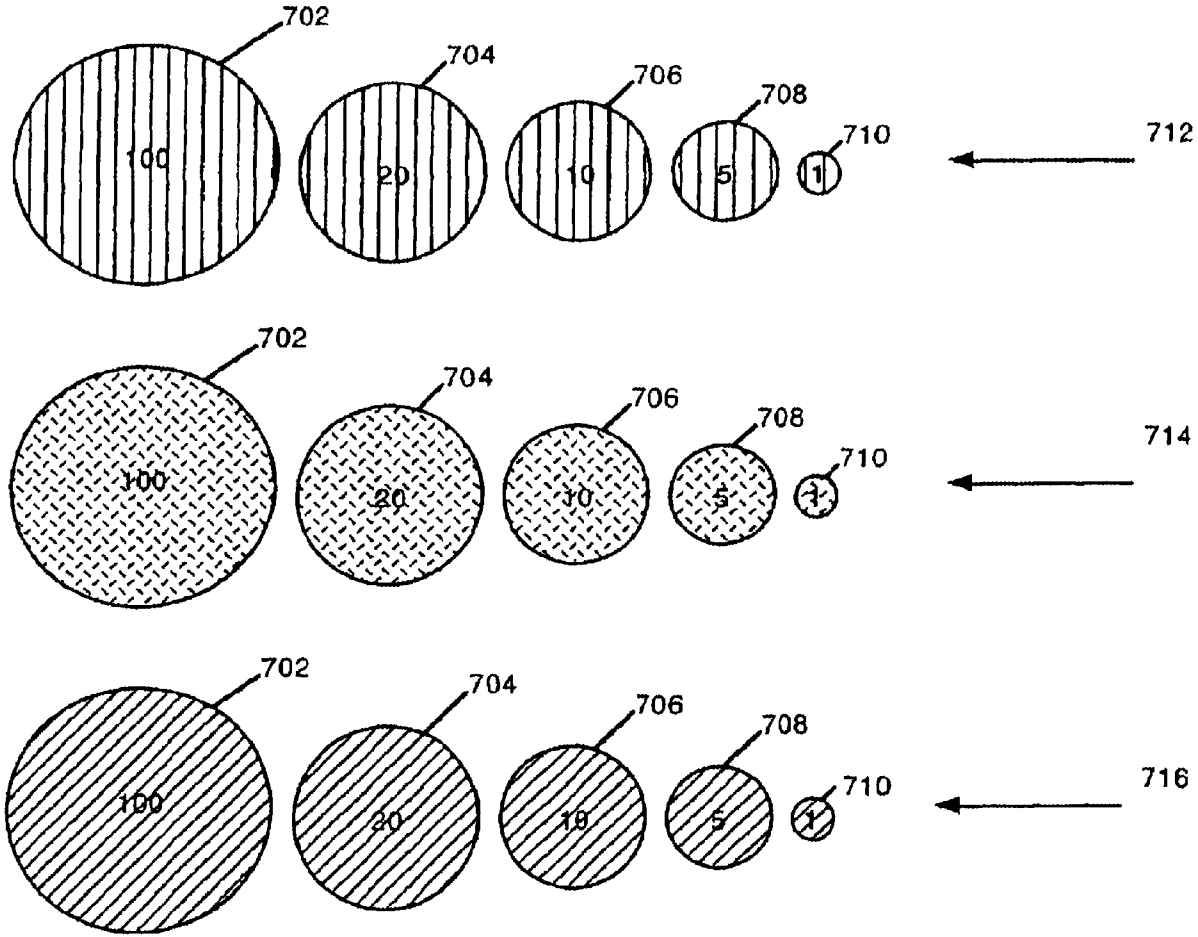
FIG. 7 is a top plan view of another preferred set of chips suitable for use with the table top of FIG. 6.

Turning to FIGS. 6–7, another preferred table and associated chips will be described. In this version, top 600 is rectangular in shape with somewhat rounded corners. Top 600 is sized to allow more players to participate in the game than top 400 (shown in FIG. 4). Specifically, top 600 includes eight player positions 602 arranged around the perimeter. Top 600 also includes a dealer position 604 and a cashier position 605. The dealer position 604 and cashier positions are located midway along the length of top 600, on opposite sides. From the perspective of dealer position 604, the first four player positions 602 (numbered 1–4) are located to the left, and the last four player positions 602 (numbered 5–8) are located to the right.

Proximate the dealer position 604, top 600 includes an area for establishing an upper and a lower competition as well as associated areas for placing bets. More specifically, top 600 includes an upper right rectangle 608 and an upper left rectangle 609, adjacent thereto. The dealer places cards within the boundaries of these rectangles to establish the upper competition. Preferably, these rectangles are larger than and approximately proportional to the size of the cards. Top 600 also includes a lower right rectangle 610 and a lower left rectangle 611, adjacent thereto. The dealer places cards within the boundaries of these rectangles to establish the lower competition. As described above, if the dealer generates a match while establishing the lower competition, the matching card is not placed in the lower competition, but is raised to the upper competition and placed proximate the matching card. For example, if a match is made between the cards placed in rectangle 610 and rectangle 609, then the card in rectangle 610 is raised diagonally to a position proximate rectangle 609.

Each of the rectangles 608, 609, 610 and 611 have a betting area 612, 613, 614 and 615, associated therewith, respectively. The betting areas 612, 613, 614 and 615 are substantially the same. With reference to betting areas 612 and 613, each includes an outer window bet area 616 and an inner match bet area 618. Initially, players place bets in the window bet area 616. As described above, after drawing only one card during the match phase of play, the dealer promotes such chips from the window bet area 616 to the match bet area 618.

Before placing such a bet, the player must purchase chips. Unlike top 400 (shown in FIG. 4), the betting areas on top 600 do not differentiate between players. Instead, in order to track individual bets, each player is issued chips that bear a unique visual marking. Preferably, each player is issued a different color of chip but other visual indicia may be used (e.g., stripes or other patterns). Top 600 includes a recessed area 620 for a chip box, which is situated proximate cashier position 605. As players join the game, the cashier ensures that none have the same color chips as those of another player. Preferably, each player position will have an associated color.

Top 600 also includes a recessed area 622 for an automatic card shuffler. This is used in the same manner as the automatic shuffler 422 described above.

Turning to FIG. 7, one preferred chip set suitable for use with top 600 will be described. This chip set includes a one hundred dollar chip 702, a twenty-dollar chip 704, a ten dollar chip 706, a five dollar chip 708 and a one dollar chip 710. To distinguish the chips, each denomination has a different size. In addition, the chip set is divided into a number of different colors. For example chip set 712 would be blue, chip set 714 would be green, and chip set 716 would be red. A different color chip set is provided for each player position. Other visual indicia may be used to distinguish the chips.

By house rules, a player may place bets only in five-dollar increments and a window winner is paid in a ratio of eight dollars for every ten dollars bet. Thus the one dollar chip 710 may not be used to place bets. Instead, these chips are used to pay window winners. For example, if a player becomes a window winner on a five dollar bet, then that player will receive their original bet plus four of the one dollar chips 710.

When the chip set shown in FIG. 7 is used in conjunction with the table shown in FIG. 6, then each player position 602 is assigned a different color. As new players join, they purchase chips from the cashier, who monitors the assignment of such colors. During the game, players may place bets by positioning their chips in one of the outer window bet areas 616. After one card has been drawn from the deck, the dealer or the cashier moves such bets into the inner match bet areas 618. When winners or losers are determined, the cashier tenders payment on winning bets and collects losing bets. Meanwhile, the dealer retrieves the deck of cards and exchanges it with a deck in the automatic shuffler.

Figure 8:
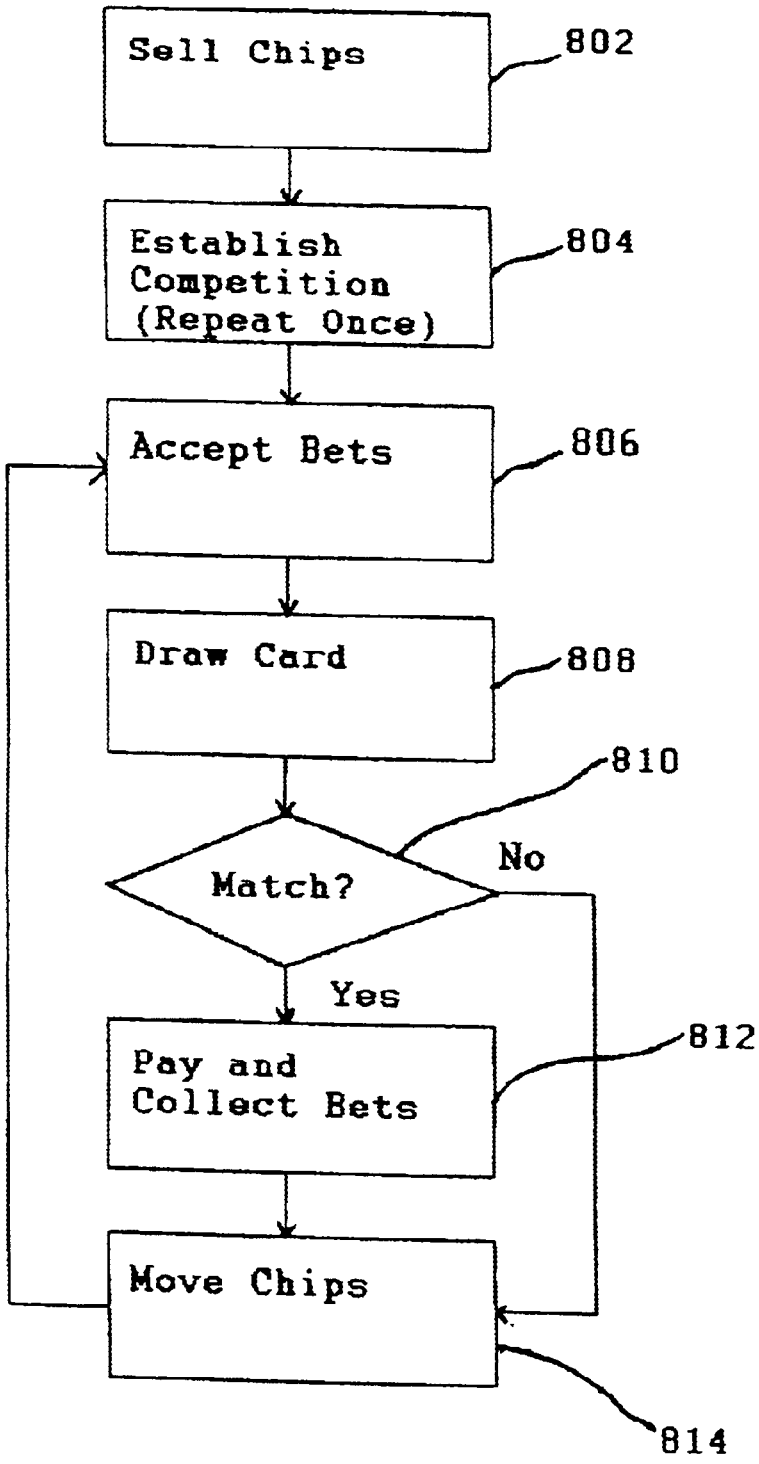
FIG. 8 is a flow chart showing one preferred method of playing the game of Monte.

Turning to FIG. 8, one preferred method of operating the tables shown in FIGS. 4 and 6 will be described. Beginning at step 802, the casino sells chips to players. Ordinarily, the chips are sold at an even exchange, however, the casino may charge a slight premium over face value. For example, the casino might charge one hundred dollars ($100) for ninety-five dollars ($95) worth of chips.

After players have purchased chips, the casino establishes a first competition at step 804. Then, players are allowed to place bets on that competition at step 806. The casino then establishes the second competition and allows players to place bets on the second competition at steps 804 and 806, respectively. During the process of establishing the second competition, the casino may determine the winner in the first competition. This occurs when three cards of the same value are raised to the first competition. When this happens, the casino pays any winning bets and collects any losing bets (not shown in FIG. 8).

After establishing the competitions, the casino begins to draw a card from the deck at step 808. The card is compared to the cards remaining in competition at step 810. If the card matches any cards in play, then the matching card and any bets associated therewith win the respective competition. Accordingly, at step 812, the casino pays any winning bets and collects any losing bets. Window winners are paid less then their bet, match winners are paid in the same amount as their bet.

After paying and collecting bets at step 812, or after determining that a match was not made at step 810, the dealer moves any chips in a window winner position to a match winner position at step 814.

The process then returns to step 806 and the subsequent steps are repeated until the casino determines a winner for both competitions.

When a player quits, their chips may be redeemed for cash. Ordinarily, the chips are bought at an even exchange, however, the casino may charge a slight commission.

Figure 9:
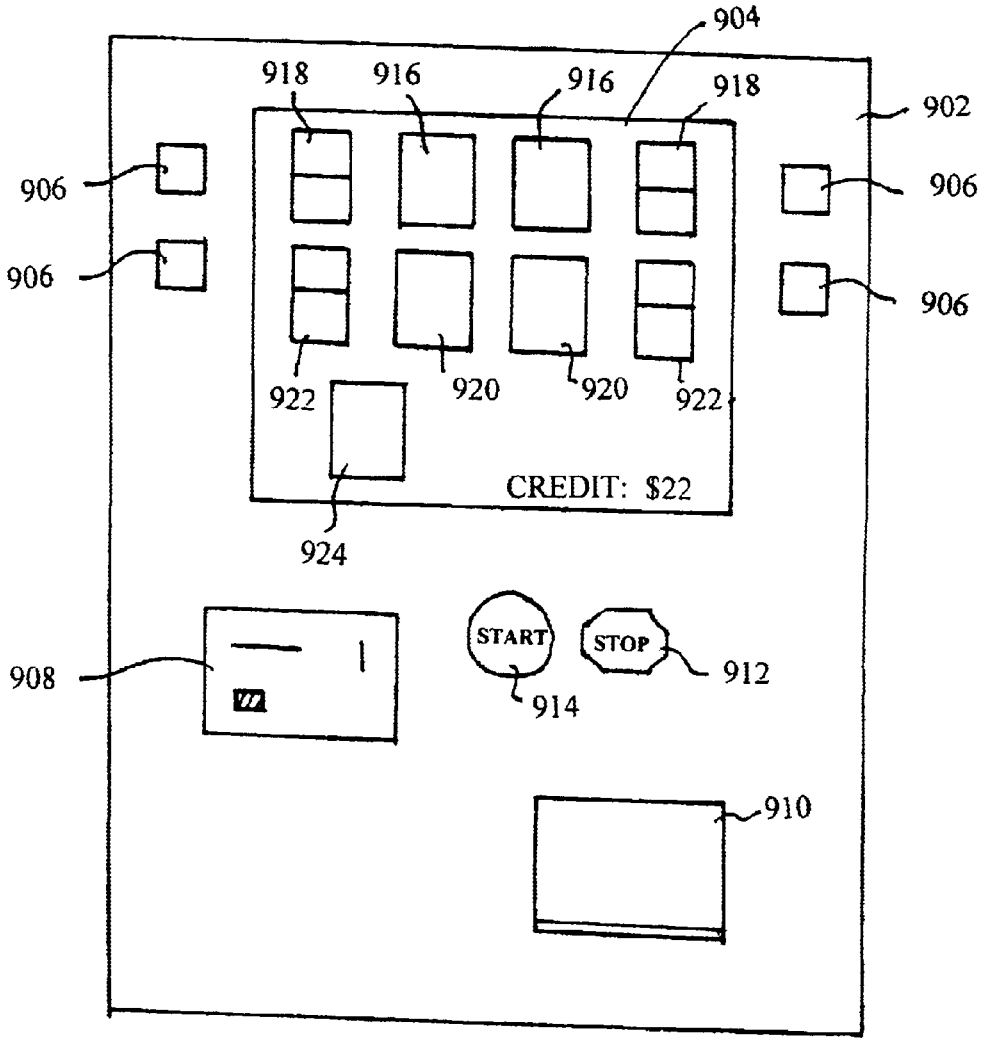
FIG. 9 is a front view of a computerized gaming machine configured for play of the game of Monte.

Turning to FIG. 9, another preferred embodiment of the casino game will be described in an electronic implementation. This configuration includes a chassis 902 configured to house the various components and to provide an attractive user interface. More specifically, chassis 902 houses a display 904, four bet buttons 906, a deposit interface 908, a coin return 910, a stop button 912 and a start button 914.

In operation, a player begins by depositing money through deposit interface 908, which is configured to accept both paper and coin currency. As a player deposits money, the deposit interface passes the paper or coins through a recognition system. For paper currency, the value is determined by optical recognition. For coins the value is determined mechanically. Once the value is determined, the player's balance is credited in that amount.

In many casinos, players are issued tokens by a central cashier. In those circumstances, the deposit interface is configured to accept such coins instead of actual currency.

After making a deposit, the player may press the start button 914. This initiates play. Internally, a computer shuffles a virtual deck of cards and establishes an upper competition. The cards in the upper competition are shown on display 904 as cards 916. The player may then place bets on the competition by activation of one of the bet buttons 906. For example, to bet on the upper right card 916, the upper right bet button 906 is activated. Bets are made in increments of the casino minimum. Here, the casino minimum is five dollars, and window winner bets are paid at eighty percent (80%). Thus, if the player places a bet, five dollars will be subtracted from the player's credit and placed in the bet area 918 adjacent the associated card 916. Each bet area 918 is divided into an upper and a lower portion. When a player initially places a bet it is shown in the upper portion or window winner portion.

After accepting bets on the upper competition, the computer establishes a lower competition. The cards in the lower competition are shown on display 904 as cards 920. The player may then place bets on the competition by activation of one of the bet buttons 906. For example, to bet on the lower left card 920, the lower left bet button 906 is activated. The bet is displayed in a bet area 922 associated with the selected card. As with bet areas 918, bet areas 922 are also divided into a window winner portion and a match winner portion.

After establishing the competitions, the computer determines the next card in play. That card is shown as card 924 on display 904. The computer compares the value of card 924 with that of the cards in competition, if that comparison generates a match, the player is paid as a window winner. The proceeds are added to the players credit and the respective competition area is cleared. Alternatively, if card 924 does not generate a match, the computer changes the status of any pending bets to match bets. The bets are then moved on the display from the window bet area to the associated match bet area.

The computer then determines the next card in play. That card replaces the previous card shown as card 924, and the process of determining a winner is repeated. If the player wins on a bet in the match winner area, the proceeds from the bet are added to the player's credit.

During the process of drawing cards from the deck to determine winners in the competitions, a player may place a new bet. To begin this process, the player activates stop button 912. The player may then activate any of the bet buttons to place a bet. The bet is initially placed in the window winner area, then moved to the match winner area after drawing one card.

The game continues in this fashion until the player wins or loses any pending bets. Upon completion of a game the player is permitted to begin a new game or to have any remaining credit returned.

Figure 10:
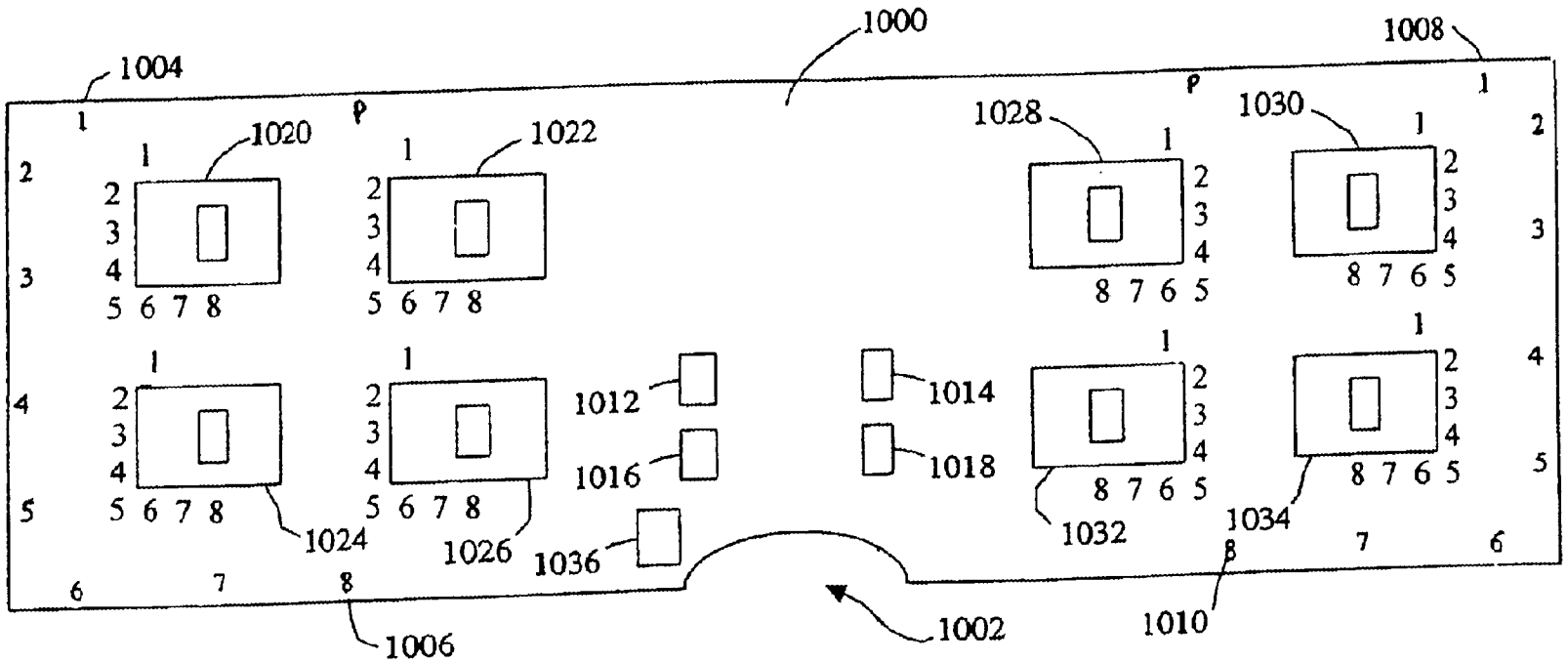
FIG. 10 is a top plan view of another preferred table top configured for play of the game of Monte in a casino.

Turning to FIG. 10, another preferred table top 1000 configured for use in a casino is described. The table top 1000 includes a dealer area 1002, as well as sixteen player stations arranged around the circumference of the table. To the left of the dealer area 1002, the positions are numbered one through eight. Left player position one 1004 is furthest from the dealer and left player position eight 1006 is closest to the dealer. To the right of the dealer area 1002, the positions are also numbered one through eight. Right player position one 1008 is furthest from the dealer and right player position eight 1010 is closest to the dealer.

The game proceeds as described above, where the dealer establishes an upper competition at card positions 1012 and 1014, and a lower competition at card positions 1016 and 1018. From the left player positions, bets may be placed adjacent bet areas 1020, 1022, 1024 or 1026, which are associated with card positions 1012, 1014, 1016 and 1018, respectively. Each of the bet areas 1020, 1022, 1024 and 1026 includes a bet area for each of the players, which are numbered one through eight. By way of example, a person at left player position one 1004 may place a bet on the card in position 1012 by positioning a chip on or about the area numbered one adjacent bet area 1020.

From the right player positions, bets may be placed in bet areas 1028, 1030, 1032 and 1034, which are associated with card positions 1012, 1014, 1016 and 1018, respectively. Again, by way of example, a person at right player position eight 1010 may place a bet on the card in position 1018 by positioning a chip on or about the area numbered eight adjacent bet area 1034.

The table may also include designations for two-player positions (P). Preferably, these are positioned on the opposite side as dealer position 1002, with one proximate bet areas 1020, 1022, 1024 and 1026, and one proximate bet areas 1028, 1030, 1032 and 1034. The table also includes a card shuffle area 1036.

Although the invention has been described with reference to specific preferred embodiments, those skilled in the art will appreciate that many variations and modifications are possible without departing from the scope of the invention. The following claims are intended to encompass all such modifications and variations.

We claim:

1. A method of operating a table in a casino comprising the steps of:

providing a first deck of cards having a first background color, and a second deck of cards having a second background color different than the first background color, wherein each of the decks includes forty cards divided equally into four suits, wherein each suit includes cards numbered one through seven and ten through twelve;

providing chips of different colors to a plurality of players so that one player's chips may be visually distinguished from another player's chips based upon color, and wherein the chips include a plurality of denominations that are whole number multiples of ten dollars;

establishing an upper competition between two cards from the first deck of cards by placing a first card adjacent a first betting area, and placing a second card adjacent a second betting area;

establishing a lower competition between two cards from the first deck of cards by placing a third card adjacent a third betting area, and placing a fourth card adjacent a fourth betting area;

accepting bets from players, wherein the bets are placed as chips in denominations that are whole number multiples of ten dollars positioned in the first, second, third and fourth betting areas;

drawing cards from the first deck of cards and placing those cards in a discard area positioned outside the first, second, third and fourth betting area, wherein each of the cards are compared with the first and second cards in the upper competition and to the third and fourth cards in the lower competition to generate matches there between;

moving the bets from a window winner area to a match winner area within the first, second, third and fourth betting areas after drawing one card from the deck and before drawing another card from the deck;

tendering payment on any winning bets in an amount that is a whole number multiple of one dollar, wherein the payment is made in an amount less than the bet when such winning bets occur on the first card drawn after placing such winning bets, and wherein the payment is made in an amount equal to such winning bets when such winning bets occur after the first card drawn after placing such winning bets;

collecting any losing bets; and automatically shuffling the second deck of cards during any of the above steps.

2. The method off claim 1, wherein the table comprises an electronic table viewed on a display.

3. A method of operating a table in a casino comprising the steps of:

providing a deck of cards;

providing chips to a plurality of players wherein the chips include unique indicia so that one player's chips may be visually distinguished from another player's chips, and wherein the chips include a plurality of denominations;

establishing a competition between two cards from the deck of cards;

accepting bets from players, wherein each bet is associated with one of the two cards in the competition;

drawing cards from the deck of cards to generate a match between one of the two cards in the competition moving the chips associated with a bet from a window winner area to a match winner area after drawing one card from the deck and before drawing a second card from the deck;

tendering payment on any winning bets in an amount that is a whole number multiple of one dollar, wherein the payment is made in an amount less than the bet when such winning bets occur on the first card drawn after placing such winning bets, and wherein the payment is made in an amount equal to such winning bets when such winning bets occur after the fist card drawn after placing such winning bets; and collecting any losing bets.

4. The method of claim 3, wherein the step of providing a deck of cards further comprises providing a first deck having a first background color, and a second deck having a second background color different than the first background color, and wherein each of the decks includes forty cards divided equally into four suits, wherein each suit includes cards numbered one through seven and ten through twelve, and wherein one of the decks are shuffled while the other deck is used for play.

5. The method of claim 3, wherein the step of providing chips to a plurality of players comprises providing chips of different colors to the plurality of players so that one player's chips may be visually distinguished from another player's chips based upon the colors.

6. The method of claim 5, wherein the step of providing chips to a plurality of players further comprises providing chips having values that are whole number multiples of ten dollars.

7. The method of claim 3, wherein the step of establishing the competition between two cards from the deck of cards comprises placing a first card adjacent a first betting area, and placing a second card adjacent a second betting area.

8. The method of claim 7, wherein the step of accepting bets from the players comprises accepting bets placed as chips positioned in the first betting area and the second betting area.

9. The method of claim 8, wherein the step of accepting bets from players comprises accepting bets placed in denominations that are whole number multiples of ten dollars only.

10. The method of claim 3, wherein the step of drawing cards from the deck of cards to generate a match between one of the two cards in the competition comprises placing the cards face-up in a discard area defined by boundaries outside the first and second betting areas.

11. A method of operating a casino game comprising the steps of:

providing a table having a plurality of player positions, an upper and a lower competition area, a first and a second card area within each of the upper and lower competition areas, a betting area associated with each of the first and second card areas, wherein each of the betting areas are divided into a window winner area and a match winner area;

providing a first deck of cards having a plurality of suits, wherein each of the suits includes a plurality of numbered cards;

providing chips in denominations that are whole numbers to a plurality of players;

establishing a first competition in the first competition area by placing cards from the first deck of cards in the first and the second card areas associated therewith;

establishing a second competition in the second competition area by placing cards from the first deck of cards in the first and the second card areas associated therewith;

accepting bets placed by positioning chips in any one of the window winner areas;

drawing cards from the first deck of cards and comparing those cards with the cards in the first and second competition;

moving bets positioned in the window winner areas to the match winner areas moving the chips from the window winner area to the match winner area occurs after drawing a first card and before drawing a second card from the first deck of cards; and settling bets by tendering payment on winning bets and collecting losing bets.

12. The method of claim 11, wherein each of the first and second card areas comprise a substantially rectangular boundary having dimensions approximately proportional to those of the first deck of cards;

wherein the step of establishing the first competition comprises placing cards from the first deck of cards within the substantially rectangular boundaries that comprise the first and second card areas of the first competition area; and wherein the step of establishing the second competition comprises placing cards from the first deck of cards within the substantially rectangular boundaries that comprise the first and second card areas of the second competition area.

13. The method of claim 12, wherein the step of providing the table further comprises providing the table having a discard area; and wherein the step of drawing cards from the first deck of cards comprises placing discarded cards in the discard area.

14. The method of claim 12, wherein the player positions are numbered, and each of the betting areas comprise a plurality of numbered areas each associated with one of the player positions, and wherein each of the plurality of numbered areas includes a portion of the window winner area and of the match winner area; and wherein the step of accepting bets comprises accepting bets positioned in the plurality of numbered areas only when such bets are placed from the associated player position.

15. The method of claim 11, wherein the step of providing the first deck of cards further comprises providing a second deck of cards having a plurality of suits, wherein each of the suits includes a plurality of numbered cards, and wherein the second deck of cards has a different background color than that of the first deck of cards; and wherein the method further comprises the step of automatically shuffling the second deck of cards during play of the first deck of cards.

16. The method of claim 11, wherein the step of providing chips comprises providing chips in a plurality of colors so that each player receives a different color.

17. The method of claim 11, wherein the step of settling bets comprises tendering payment on winning bets positioned in the window winner areas in an amount less than the respective bets, and tendering payment on winning bets positioned in the match winner area in an amount equal to the respective bets, and wherein payment is made in whole number multiples of one dollar.

18. The method of claim 11, wherein the step of providing the table comprises providing the table having fewer than six player positions.

19. The method of claim 11, wherein the step of providing the table further comprises providing the table having a discard area, and wherein the player positions are numbered, each of the first and second card areas comprise a substantially rectangular boundary having dimensions approximately proportional to those of the first deck of cards, and each of the betting areas comprise a plurality of numbered areas each associated with one of the player positions, and wherein each of the plurality of numbered areas includes a portion of the window winner area and of the match winner area;

wherein the step of providing the first deck of cards further comprises providing a second deck of cards having a plurality of suits, wherein each of the suits includes a plurality of numbered cards, and wherein the second deck of cards has a different background color than that of the first deck of cards;

wherein the step of establishing the first competition comprises placing cards from the first deck of cards within the substantially rectangular boundaries that comprise the first and second card areas of the first competition area;

wherein the step of establishing the second competition comprises placing cards from the first deck of cards within the substantially rectangular boundaries that comprise the first and second card areas of the second competition area;

wherein the step of accepting bets comprises accepting bets positioned in the plurality of numbered areas only when such bets are placed from the associated player position;

wherein the step of drawing cards from the first deck of cards comprises placing cards in the discard area;

wherein the step of moving the chips from the window winner area to the match winner area occurs after drawing a first card and before drawing a second card from the first deck of cards;

wherein the step of settling bets comprises tendering payment on winning bets positioned in the window winner areas in an amount less than the respective bets, and tendering payment on winning bets positioned in the match winner area in an amount equal to the respective bets, and wherein payment is made in whole number multiples of one dollar; and wherein the method further comprises the step of automatically shuffling the second deck of cards during play of the first deck of cards.

20. The method of 11, wherein the betting areas each comprise a plurality of player areas that include a portion of the window winner area and a portion of the match winner area, and wherein the plurality of player areas are arranged in the same order as the player positions.

21. The method of claim 20, wherein the window winner areas are positioned nearer to the player positions than the associated match winner area.

22. The method of claim 11, wherein the table comprises an electronic table viewed on a display.

* * * * *